US009944362B2

(12) United States Patent
Damore

(10) Patent No.: US 9,944,362 B2
(45) Date of Patent: Apr. 17, 2018

(54) SURFBOARD BAG WITH RELEASE TAB

(71) Applicant: Dean R. Damore, Brightwaters, NY (US)

(72) Inventor: Dean R. Damore, Brightwaters, NY (US)

( * ) Notice: Subject to any disclaimer, the term of this patent is extended or adjusted under 35 U.S.C. 154(b) by 0 days.

(21) Appl. No.: 15/267,674

(22) Filed: Sep. 16, 2016

(65) Prior Publication Data

US 2017/0096200 A1 Apr. 6, 2017

Related U.S. Application Data

(60) Provisional application No. 62/236,240, filed on Oct. 2, 2015.

(51) Int. Cl.
*B63B 35/79* (2006.01)

(52) U.S. Cl.
CPC ..... *B63B 35/7946* (2013.01)

(58) Field of Classification Search
CPC ..... B63B 35/79; B63B 35/7946; B63B 35/85; B65D 81/02; B65D 81/05; B65D 85/00; B65D 85/30
USPC ..... 206/315.1
See application file for complete search history.

(56) References Cited

U.S. PATENT DOCUMENTS 3,339,607 A * 9/1967 Howard ..... B63B 35/7946 206/315.1
6,003,745 A * 12/1999 Mechanic ..... B63B 35/7946 206/315.1
7,017,747 B2 * 3/2006 Kiger ..... B63B 35/7946 206/315.1
7,780,355 B2 * 8/2010 Malloy ..... B63B 35/7946 206/315.1
2010/0006469 A1 * 1/2010 Allouche ..... B63B 35/7946 206/315.1
2013/0043152 A1 * 2/2013 Muroki ..... B63B 35/7946 206/315.1

FOREIGN PATENT DOCUMENTS

DE 102014113855 * 3/2016 ..... B63B 35/7946

* cited by examiner

*Primary Examiner* — Bryon Gehman
(74) *Attorney, Agent, or Firm* — Carter, DeLuca, Farrell & Schmidt, LLP

(57) ABSTRACT

A surfboard bag includes a body having first and second sides, a closed end, and an open end. The body is formed from upper and lower exterior surfaces of a first material and upper and lower interior surfaces of a second, different material. The surfaces of the body are joined to one another along the first and second sides of the body and the closed end of the body so as to define an interior cavity. The open end of the body defines a mouth providing access to the interior cavity. One or more release tabs are disposed on the upper exterior surface of the body and/or the lower exterior surface of the body. The release tab(s) are spaced-apart from the first and second sides of the body and spaced-apart from the open and closed ends of the body. The release tab(s) are configured to facilitate breaking a seal created by board sticking between a surfboard disposed within the interior cavity and the upper exterior surface of the body and/or the lower exterior surface of the body.

12 Claims, 3 Drawing Sheets

SURFBOARD BAG WITH RELEASE TAB

CROSS-REFERENCE TO RELATED APPLICATIONS

This application claims the benefit of U.S. Provisional Patent Application No. 62/236,240 filed on Oct. 2, 2015, the entire contents of which are hereby incorporated herein by reference.

BACKGROUND

Technical Field

The present disclosure relates to a surfboard bag configured to facilitate transport of one or more surfboards and protect the surfboards) during transport and insertion/removal from the surfboard bag.

Background of the Disclosure

Surfboard bags are generally known in the art for facilitating transport of one or more surfboards and for protecting the surfboard(s) during transport. Such surfboard bags may include zippers or other closure mechanisms to retain the surfboard(s) within the bag, padding to protect the surfboard(s), exterior pockets to retain accessories or other items, and/or handles to facilitate transport of the surfboard(s).

Despite the above-noted advantageous features, prior art surfboard bags are susceptible to board sticking. Board sticking occurs, particularly on warm-weather days, where the wax on the surfboard melts and then re-hardens such that the surfboard and the interior of the bag are sealed to one another. Once board sticking has set it, it is difficult to remove the surfboard from the bag without damaging the surfboard and/or the bag.

Accordingly, there is a continuing need for a surfboard bag configured to facilitate the separation of the bag from the surfboard in the event of board sticking with relative ease and without damaging the surfboard and/or the bag.

SUMMARY

Provided in accordance with aspects of the present disclosure is a surfboard bag including a body having first and second sides, a closed end, and an open end. The body is formed from upper and lower exterior surfaces of a first material, e.g., terry cloth, canvas, or other suitable material, and upper and lower interior surfaces of a second, different material, e.g., a tarpaulin made from vinyl, polyethylene, etc., or other suitable material. The surfaces of the body are joined to one another along the first and second sides of the body and the closed end of the body so as to define an interior cavity. The open end of the body defines a mouth providing access to the interior cavity. One or more release tabs are disposed on the upper exterior surface of the body and/or the lower exterior surface of the body. The release tab(s) are spaced-apart from the first and second sides of the body and spaced-apart from the open and closed ends of the body. The release tab(s) are configured to facilitate breaking a seal created by board sticking between a surfboard disposed within the interior cavity and the upper exterior surface of the body or the lower exterior surface of the body.

In aspects of the present disclosure, the surfaces of the body are joined to one another along the first and second sides of the body and the closed end of the body via stitching.

In aspects of the present disclosure, at the open end of the body, the upper exterior and interior surfaces are joined to one another and the lower exterior and interior surfaces are joined to one another. These surfaces, in aspects, may be joined to one another via stitching.

In aspects of the present disclosure, the upper exterior surface of the body and/or the lower exterior surface of the body includes two or more release tabs. The two or more release tabs are laterally centered relative to the first and second sides of the body. Additionally or alternatively, the two or more tabs may be equally-spaced longitudinally relative to each other and the ends of the body.

In aspects of the present disclosure, each release tab includes a first end, a second end, and a central portion. In such aspects, each release tab is joined to the body at the first and second ends of the release tab. More specifically, the first and second ends of each release tab may be stitched to the body.

In aspects of the present disclosure, a pocket is disposed within the interior cavity of the body. The pocket may be stitched to the upper interior surface of the body or the lower interior surface of the body.

BRIEF DESCRIPTION OF THE DRAWINGS

Aspects and features of the present disclosure are described herein with reference to the accompanying drawings, wherein.

DETAILED DESCRIPTION

Figure 1:
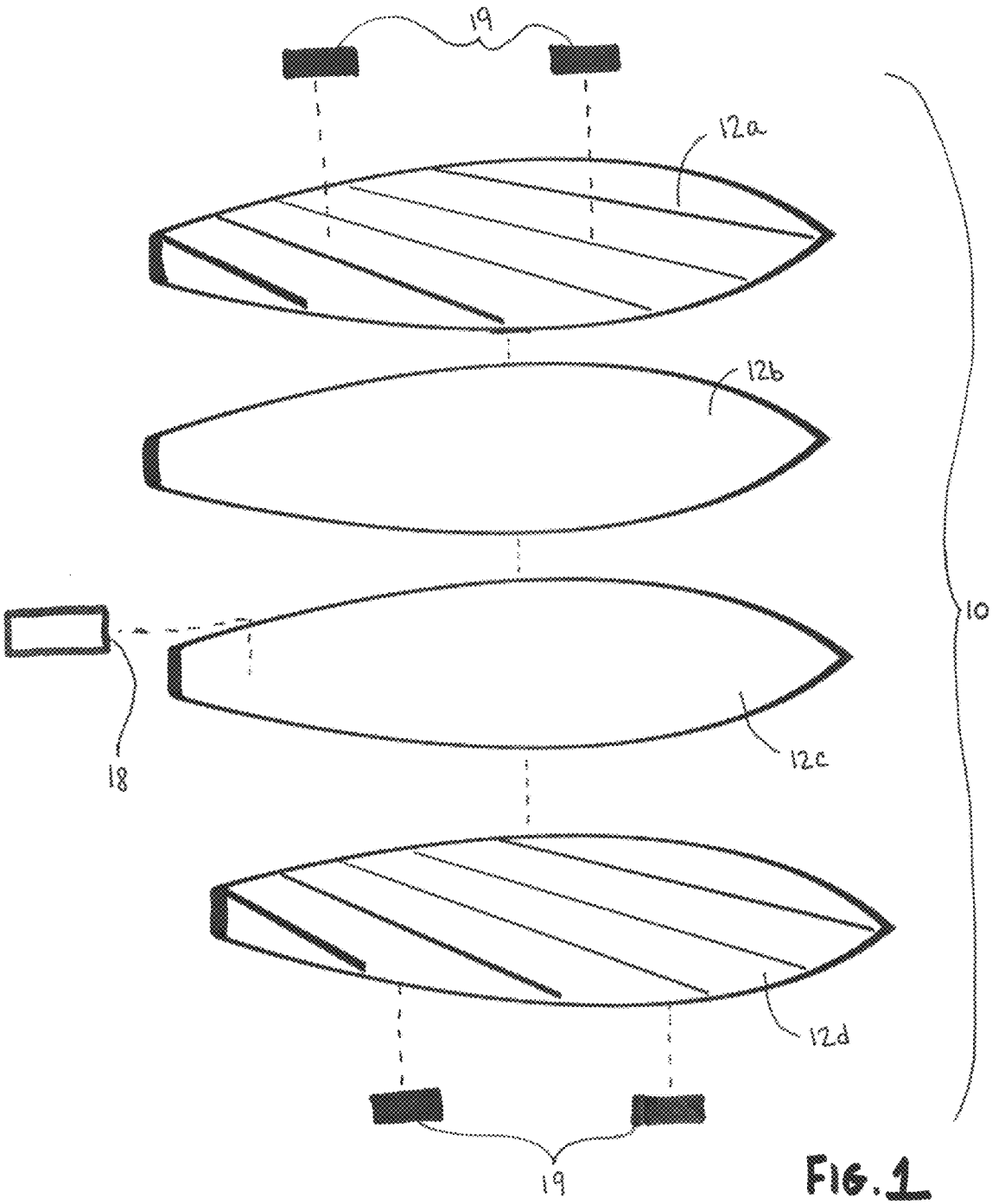
FIG. 1 is an exploded, side view of a surfboard bag provided in accordance with aspects of the present disclosure.

Various embodiments of the present disclosure will now be described in detail with reference to the drawings, wherein like reference numerals identify similar or identical elements. In the following description, well known functions or constructions are not described in detail to avoid obscuring the present disclosure. To the extent consistent, any of the aspects and/or features of any of the embodiments detailed herein may be used in conjunction with any of the aspects and/or features of any of the other embodiments detailed herein.

Figure 2A:
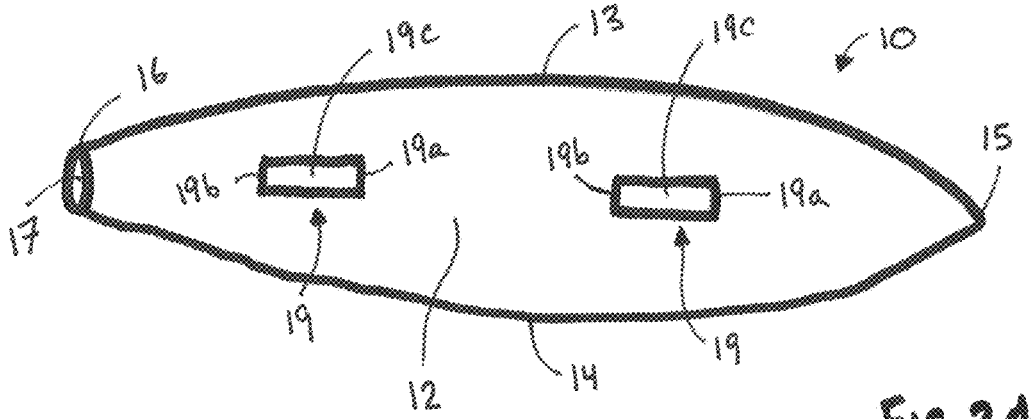
FIG. 2A is a top view of the bag of FIG. 1.
Figure 2B:
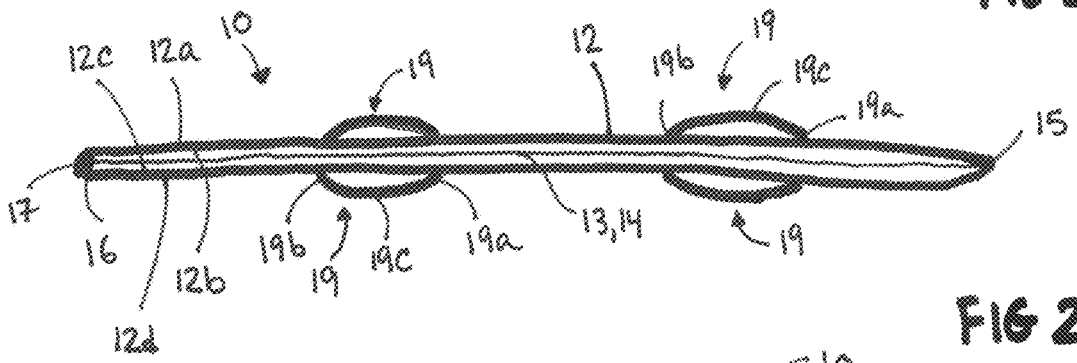
FIG. 2B is a side view of the bag of FIG. 1.
Figure 2C:
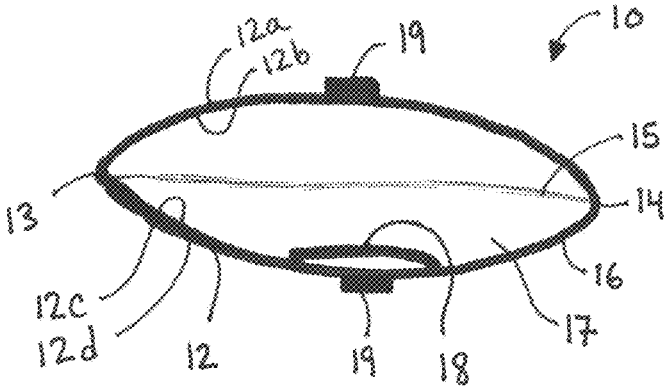
FIG. 2C is a front view of the bag of FIG. 1.

Turning to FIGS. 1-2C, a surfboard bag provided in accordance with the present disclosure is generally identified by reference numeral 10. Bag 10 defines a body 12 formed from a plurality of layers 12*a*-12*d*. More specifically, body 12 of bag 10 includes an upper outer layer 12*a*, an upper inner layer 12*b*, a lower inner layer 12*c*, and a lower outer layer 12*d*. The outer layers 12*a*, 12*d* of body 12 of bag 10 may be formed from a durable, water-resistant, UV-resistant material such as terry cloth, canvas or other suitable textile. The inner layers 12*b*, 12*c* of body 12 of bag 10 may made from tarpaulin of, for example, vinyl, polyethylene, or other suitable durable, waterproof material.

Body 12 further defines a first side 13, a second side 14, a closed end 15, and an open end 16. Layers 12*a*-12*d* are stitched to one another about the outer peripheries thereof along first and second sides 13, 14, respectively, and closed end 15 of body 12. However, all of the layers 12*a*-12*d* are not stitched together at open end 16 of body 12 so as to define a mouth 17 providing access to the interior cavity of body 12 of bag 10. Rather, at open end 16 of body 12, upper outer layer 12*a* and upper inner layer 12*b* are stitched to one another and lower inner layer 12*c* and lower outer layer 12*d* are stitched to one another. As can be appreciated, the resultant configuration is a body 12 having an exterior defined by upper outer layer 12*a* and lower outer layer 12*d* (which, as noted above, may be formed from terry cloth, canvas, or other suitable material) and an interior cavity defined by upper inner layer 12*b* and lower inner layer 12*c* (which, as noted above, may be formed from tarpaulin or other suitable material). The interior cavity of body 12 is accessible by mouth 17 and may further include a flap (not shown) configured to releasably close mouth 17 in any suitable fashion, e.g., via folding, hook and loop fastening, buttons, latches, zippers, etc.

Bag 10 further includes and interior pocket 18 formed on the interior of body 12, e.g., on upper inner layer 12*b* or lower inner layer 12*c*, towards mouth 17. Pocket 18 is stitched to body 12 on three sides thereof, thus providing an opening to permit insertion and removal of items, e.g., board wax, car keys, and/or other accessories. Pocket 18 may further include a flap (not shown) configured to releasably close the opening in any suitable fashion, e.g., via folding, hook and loop fastening, buttons, latches, zippers, etc.

Figure 3A:
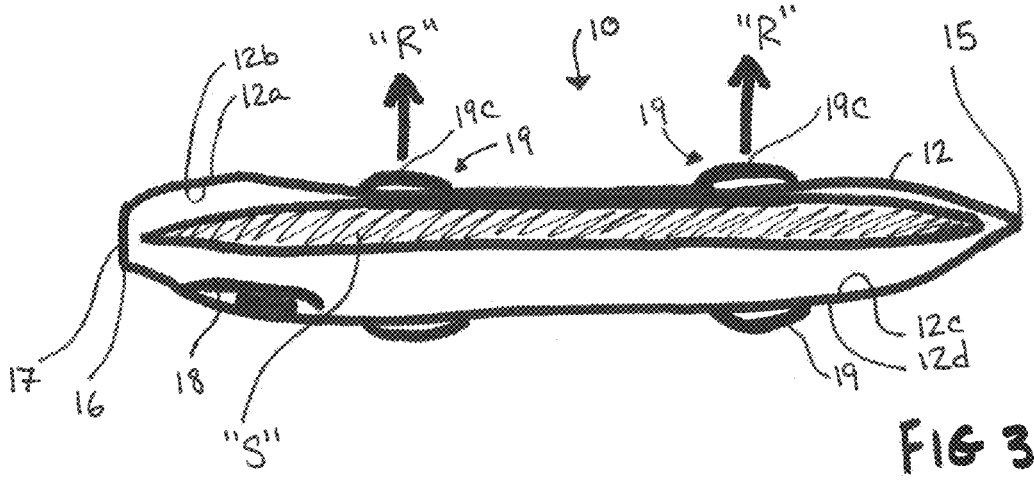
FIG. 3A is a side, cross-sectional view of the bag of FIG. 1 including a surfboard disposed therein and sealed to the interior of the bag.
Figure 3B:
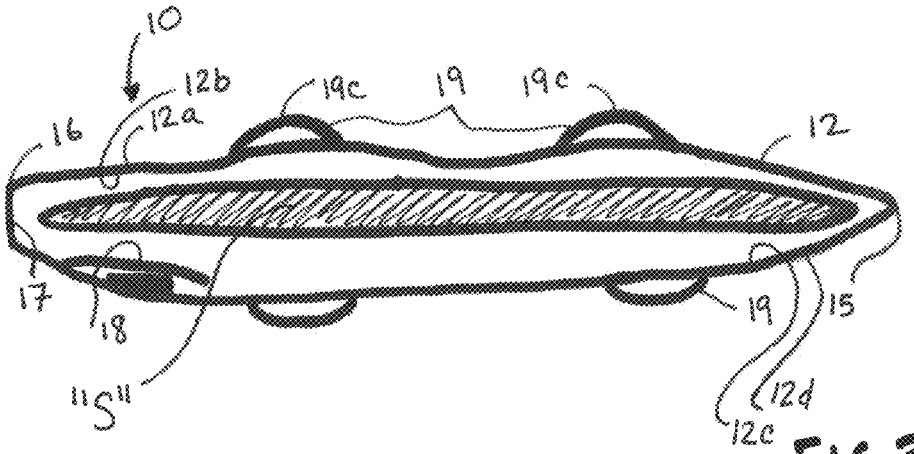
FIG. 3B is a side, cross-sectional view of the bag of FIG. 1 including a surfboard disposed therein after release of the surfboard from the interior of the bag.

With additional reference to FIGS. 3A and 3B, in order to overcome board sticking and facilitate the separation of bag 10 from a surfboard "S" disposed therein with relative ease and without damaging bag 10 or the surfboard "S," bag 10 is provided with a plurality of release tabs 19. Release tabs 19 are in the form of elongated strips of material, e.g., terry cloth, canvas, or other suitable material, having first and second ends 19*a*, 19*b*, respectively, and are positioned on outer layers 12*a*, 12*d* of body 12 of bag 10. More specifically, the ends 19*a*, 19*b* of each release tab 19 are stitched to the upper layers 12*a*, 12*b* or the lower layers 12*c*, 12*d* and positioned on the exterior of body 12. The positioning of release tabs 19 on the exterior of body 12 with only the ends 19*a*, 19*b* thereof stitched to body 12 readily enables a user to grasp a central portion 19*c* of each release tab 19, as detailed below.

Each release tab 19, as noted above, is stitched to the upper layers 12*a*, 12*b* or the lower layers 12*c*, 12*d* of body 12. Release tabs 19 are laterally centered between first and second sides 13, 14 of body 12. Longitudinally, release tabs 19 are equally spaced relative to each other, closed end 15 of body 12, and open end 16 of body 12. As illustrated in FIGS. 1, 2A, 2B, 3A, and 3B, two release tabs 19 are disposed on each outer layers 12*a*, 12*d*. Thus, in the illustrated embodiment, the first release tab 19 is longitudinally spaced-apart from closed end 15 of body 12 by approximately ⅓ of the length of body 12, and the second release tab 19 is longitudinally spaced-apart from the first release tab 19 and the open end 16 of body 12 by approximately ⅓ of the length of body 12.

For longer bags 10 configured for use with long boards, three release tabs 19 may be disposed on each outer layer 12*a*, 12*d*, e.g., spaced-apart from each other and the closed and open ends 15, 16, respectively, of body 12 by approximately ¼ the length of body 12. On the other hand, for shorter bags 10 configured for use with short boards, a single release tab 19 may be provided on each outer layer 12*a*, 12*d*, e.g., spaced-apart from the closed and open ends 15, 16, respectively, of body 12 by approximately ½ the length of body 12. Other configurations are also contemplated, depending upon the size of the bag 10 which, in turn, is dependent upon the size of the surfboard "S" configured for receipt therein. For example, in embodiments where two release tabs 19 are provided, the release tabs may be spaced-apart from one another by approximately ⅕ the length of body 12 and spaced-apart from the nearest end 15, 16 by approximately ⅖ of the length of body 12. Additionally or alternatively, multiple rows of release tabs 19 may be provided with the release tabs 19 of each row laterally-spaced from each other and sides 13, 14 of body 12.

Referring to FIGS. 3A and 3B, and initially to FIG. 3A, bag 10 is shown including the surfboard "S" disposed within the internal cavity of body 12, wherein board sticking has occurred resulting in the surfboard "S" being sealed to upper inner layer 12*b* of body 12. As a result of this board sticking, removal of the surfboard "S" from bag 10 without damaging bag 10 and/or the surfboard "S." In order to break the seal and release upper inner layer 12*b* of bag 10 from the surfboard "S," and, thus, enable relatively easy removal of the surfboard "S" from bag 10 without damaging bag 10 and/or the surfboard "S," the user grasps the central portion 19*c* one or both of release tabs 19 and pulls release tab(s) 19 upwardly away from the surfboard "S" in the direction of arrows "R."

Due to the lateral positioning of release tabs 19 away from sides 13, 14 of body 12, release tabs 19 are positioned towards the lateral center of the upper surface of the surfboard "S," rather than being position adjacent an edge thereof. Likewise, due to the longitudinal positioning of release tabs 19 spaced-apart from the ends 15, 16 of body 12, release tabs 19 are generally spaced-apart from the ends of the surfboard "S." As a result of this configuration, pulling release tab(s) 19 upwardly away from the surfboard "S" in the direction of arrows "R," provides a pulling force across substantially the entire surface area of upper layers 12*a*, 12*b* of body 12 of bag 10 away from the upper surface of surfboard "S." That is, the pulling force exerted on upper layers 12*a*, 12*b* is sufficiently spread about the entire surface area of upper layers 12*a*, 12*b* of body 12 of bag 10 so as to break the seal between the surfboard "S" and inner upper layer 12*b* of body 12 and release inner upper layer 12*b* of body 12 from the upper surface of surfboard "S." Once released in this manner, the surfboard "S" can be easily removed from bag 10 via mouth 17 at open end 16 of body 12

In addition to their primary function of facilitating breaking the seal between the surfboard "S" and the interior of body 12 of bag 10, release tabs 19 may additionally be used as handles to facilitate transport of bag 10, tying loops to enable tying bag 10 to a roof rack or other structure (not shown), and/or attachment loops to allow attachment of a carrying strap (not shown) to bag 10. It should be noted that, while handles, tying loops, and/or attachment loops disposed along ends and/or sides of a surfboard bag may be provided for any or all of the above-noted additional functions, the positioning of such handles, tying loops, and/or attachment loops along the ends and/or sides of the surfboard bag cannot be used to readily break a seal created as a result of board sticking at least because the pulling force exerted on these handles, tying loops, and/or attachment loops would not be spread about a sufficiently large surface area of the bag. Rather, it is the positioning of the release tabs 19 as detailed in the above-noted embodiments of the present disclosure that enable such a feature.

It will be understood that various modifications may be made to the embodiments of the present disclosure. Therefore, the above description should not be construed as limiting, but merely as exemplifications of embodiments.

Those skilled in the art will envision other modifications within the scope and spirit of the present disclosure.

What is claimed is:

1. A surfboard bag, comprising:

a body having first and second sides, a closed end, and an open end, the body formed from upper and lower exterior surfaces of a first material and upper and lower interior surfaces of a second, different material, the surfaces of the body joined to one another along the first and second sides of the body and the closed end of the body so as to define an interior cavity, the open end of the body defining a mouth providing access to the interior cavity, the interior cavity configured to receive a surfboard therein; and at least one release tab disposed on at least one of the upper exterior surface of the body and the lower exterior surface of the body, the at least one release tab spaced-apart from the first and second sides of the body and spaced-apart from the open and closed ends of the body such that with the surfboard disposed within the interior cavity, the at least one release tab is disposed over the surfboard, the at least one release tab configured for selective manipulation to facilitate breaking a seal that had been created between the surfboard disposed within the interior cavity and at least one of: the upper interior surface of the body and the lower interior surface of the body.

2. The surfboard bag according to claim 1, wherein the surfaces of the body are joined to one another along the first and second sides of the body and the closed end of the body via stitching.

3. The surfboard bag according to claim 1, wherein, at the open end of the body, the upper exterior and interior surfaces are joined to one another and the lower exterior and interior surfaces are joined to one another.

4. The surfboard bag according to claim 3, wherein, at the open end of the body, the upper exterior and interior surfaces are joined to one another via stitching and the lower exterior and interior surfaces are joined to one another via stitching.

5. The surfboard bag according to claim 1, wherein at least one of: the upper exterior surface of the body and the lower exterior surface of the body includes at least two release tabs, the at least two release tabs laterally centered relative to the first and second sides of the body.

6. The surfboard bag according to claim 5, wherein the at least two release tabs are equally-spaced longitudinally relative to each other and the ends of the body.

7. The surfboard bag according to claim 1, wherein each release tab includes a first end, a second end, and a central portion, each release tab joined to the body at the first and second ends of the release tab.

8. The surfboard bag according to claim 7, wherein the first and second ends of each release tab are stitched to the body.

9. The surfboard bag according to claim 1, further including a pocket disposed within the interior cavity of the body.

10. The surfboard bag according to claim 9, wherein the pocket is stitched to one of: the upper interior surface of the body and the lower interior surface of the body.

11. A surfboard bag, comprising:

a body having first and second sides, a closed end, and an open end, the body formed from upper and lower exterior surfaces of a first material and upper and lower interior surfaces of a second, different material, the surfaces of the body joined to one another along the first and second sides of the body and the closed end of the body so as to define an interior cavity, the open end of the body defining a mouth providing access to the interior cavity, the interior cavity configured to receive a surfboard therein; and at least two release tabs laterally centered relative to the first and second sides of the body and spaced-apart from the open and closed ends of the body, the at least two release tabs disposed on at least one of: the upper exterior surface of the body and the lower exterior surface of the body, wherein, the at least two release tabs are configured for selective manipulation to facilitate breaking a seal that had been created between the surfboard disposed within the interior cavity and at least one of: the upper interior surface of the body and the lower interior surface of the body.

12. A surfboard bag, comprising:

a body having first and second sides, a closed end, and an open end, the body formed from upper and lower exterior surfaces of a first material and upper and lower interior surfaces of a second, different material, the surfaces of the body joined to one another along the first and second sides of the body and the closed end of the body so as to define an interior cavity, the open end of the body defining a mouth providing access to the interior cavity, the interior cavity configured to receive a surfboard therein; and at least two release tabs equally-spaced longitudinally relative to each other and the ends of the body, the at least two release tabs spaced-apart from the first and second sides of the body, the at least two release tabs disposed on at least one of: the upper exterior surface of the body and the lower exterior surface of the body, wherein, the at least two release tabs are configured for selective manipulation to facilitate breaking a seal that had been created between the surfboard disposed within the interior cavity and at least one of: the upper interior surface of the body and the lower interior surface of the body.

* * * * *